US006591579B2

(12) United States Patent
Sekulla et al.

(10) Patent No.: US 6,591,579 B2
(45) Date of Patent: Jul. 15, 2003

(54) TOOL AND METHOD FOR INSTALLING GLUELESS FLOORS

(75) Inventors: George Sekulla, Augustdorf (DE); Volker Kettler, Werther (DE)

(73) Assignee: H-W Industries GmbH & Co., KG, Dissen (DE)

( * ) Notice: Subject to any disclaimer, the term of this patent is extended or adjusted under 35 U.S.C. 154(b) by 0 days.

(21) Appl. No.: 09/809,042

(22) Filed: Mar. 16, 2001

(65) Prior Publication Data

US 2002/0129579 A1 Sep. 19, 2002

(51) Int. Cl.[7] ..... E04D 15/00

(52) U.S. Cl. ..... 52/749.1; 52/DIG. 1; 52/750; 52/747.11

(58) Field of Search ..... 52/DIG. 1, 749.1, 52/749.11, 750, 747.1, 233; 33/526, 527, 518, 613, 645

(56) References Cited

U.S. PATENT DOCUMENTS

| | | | | | |
|---|---|---|---|---|---|
| 386,553 | A | * | 7/1888 | Morse | 52/403.1 |
| 4,279,108 | A | * | 7/1981 | Collister, Jr. | 52/233 |
| 4,356,676 | A | * | 11/1982 | Hauptman | 52/403 |
| 4,426,820 | A | * | 1/1984 | Terbrack et al. | 52/590.1 |
| 5,398,423 | A | * | 3/1995 | Smith | 33/376 |
| 5,447,004 | A | * | 9/1995 | Vrnak | 52/387 |
| 5,575,132 | A | * | 11/1996 | Garsjo | 52/127.5 |
| 5,860,267 | A | * | 1/1999 | Pervan | 52/403.1 |

* cited by examiner

*Primary Examiner*—Carl D. Friedman
*Assistant Examiner*—Chi Q. Nguyen
(74) *Attorney, Agent, or Firm*—Stevens, Davis, Miller & Mosher, L.L.P.

(57) ABSTRACT

A tool and method for installing building panels, particularly flooring planks is described. The tool is shaped with an arcuate outer surface and is provided with a groove which can be placed over the edge of the floor planks. The tool and method facilitate the installation of the planks by one person.

21 Claims, 3 Drawing Sheets

TOOL AND METHOD FOR INSTALLING GLUELESS FLOORS

BACKGROUND OF THE INVENTION

1. Field of the Invention

The invention relates to a method of installing glueless floors from a plurality of planks, especially planks comprising a core, backing or substrate, such as a fiberboard, onto which is laminated an abrasion resistant surface. In one aspect of the invention, the edge of the fiberboard is milled to produce an edge profile, which, when cooperatively engaged with a complimentary edge profile on an adjacent panel, can be assembled into a floor, without the need to glue the resulting joint between such adjacent panels. The invention also relates to a tool, preferably a hand tool, which facilitates assembly of the planks into a floor.

2. Description of the Related Art

The assembly of tongue and groove floors planks is generally well known in the art. However, these planks have had to be glued together otherwise affixed to the subfloor to prevent separation of the planks. Furthermore, once laid, the planks cannot be taken up. Recently, there have been a series of method of installation patents for assembling glueless, floating floors (i.e., unglued and unfixed to the subfloor), such as described in a series of U.S. patents, i.e., U.S. Pat. No. 4,426,820 to Terbrack et al and U.S. Pat. Nos. 5,860, 267, 6,023,907 (and their related patents 5,706,621 and 6,182,410) to Tony Pervan, the entire disclosures of each of which are incorporated by reference.

These publications describe a series of manipulations of their panels which include "angling down" a new panel into a previous panel either along the long edges or short edges; See, the Terbrack et al and Tony Pervan patents. By the use of a Δ play between the cooperating locking members of their floor planks, Tony Pervan was able to displace the floor planks along a joined edge, so as to facilitate the joining of one of the, as yet, unjoined edges while the other edge remained joined. The drawback of the systems of Pervan were numerous, insofar as Pervan utilized an aluminum, other metal or plastic strip, integral or integrated with the floor panel, as one of the members of his locking system. Additionally, the presence of Δ play between the locking elements permitted a gap between panels at the joint, facilitating the entry of water at the joint as when a spill on, or washing of, the floor occurs. The gap would also permit the accumulation of dust in the gap resulting in an unsightly seam between adjacent planks. Although, as described in his patent, commercial instructions for installing the planks also required the use of a "tapping block"; i.e., a block designed to interfit with the edge profile and which needed to be hammered to join the planks.

Another flooring system is described in U.S. Pat. No. 6,006,486 to Stefan Moriau et al (the entire disclosure of which is herein incorporated by reference). Unlike Pervan, Moriau did not have Δ play in his joint such that the edges of the panel were under a tension force tending to urge adjacent planks together due in part, to a sloping locking surface and the fact that the tongue and groove locking surfaces of Moriau were milled directly into the core or substrate of the panels.

Still more recently U.S. Pat. No. 6,101,778 has issued to Göran Mårtensson (the entire disclosure of which is herein incorporated by reference). Each of the aforementioned Pervan and Moriau patents discloses at least one of the locking elements was present on an extended portion of the panel such that the interlocking of the panels was made outside of the tongue and groove connection. Mårtensson developed ajoint where interlocking in both the vertical direction (relative to a plane of the panels) as well as in the plane of the panels, was achieved by a joint where all the locking elements were within the confines of the shadow of the upper edge of the panel.

However, none of these prior art documents provide a method where an unskilled person, such as the average consumer (sometimes called in the trade "DIY" (do-it-yourselfer)), can readily assemble the panels without the aid of an assistant and with average human strength. Moreover, the edges of the panels may cut or abrade the human hand and forcing the edges may cause cracking or other damage to the edges. Thus, there exists a longstanding need to overcome the disadvantages of prior art installation methods.

The current invention overcomes the problems associated with installing the floor planks of the prior art.

These and other embodiments of the invention will become more evident in reading the following description of the invention in connection with the appended drawings.

SUMMARY OF THE INVENTION

The present invention relates to a method of installing floor planks for either a glued (e.g., conventional tongue and groove floor) or the glueless style of floor currently in vogue.

The method, in general, requires the laying out and joining of a first row (or at least a portion of the first row) short edge to short edge so as to facilitate the placement of a second (or any succeeding) row.

The second (or any succeeding) row is then assembled by inserting the first plank in the second row (long edge first) into the long edge of a previously laid plank and laying such plank against a tool of the invention placed on the edge of the first plank in the second row so as to prevent the first plank in the second row from laying flat on the subfloor.

The second (and subsequent) planks in the second (or any succeeding) row can then be joined short edge to short edge in any suitable manner, i.e., by angling down one plank relative to another and/or by horizontally displacing the planks.

However, before the second (or any succeeding) plank is permitted to come to rest, a tool of the invention is placed over the edge of the second (or any succeeding) plank so as to prevent the plank from seating flat on the subfloor.

The tool used in the invention is any device which will fit over the edge of the plank and prevent the edge of the plank from contacting the subfloor. The tool can also be used to urge the partially laid plank into engagement with an adjacent plank to join the adjacent edges.

DETAILED DESCRIPTION OF THE PREFERRED EMBODIMENTS

As shown in FIGS. 1*a*–1*d*, are four embodiments according to the prior art of glueless edge joints for joining adjacent panels together to form a floor. However, our invention is not limited to joining panels together with such edge configurations, but is suitable for any of these edge configurations as well as conventional glued tongue and groove joints. In addition, the tool of my invention may also be used for joining real wood panels and is not limited to the plastic resin or plastic-containing laminate panels as shown in the prior art.

Figure 1A:
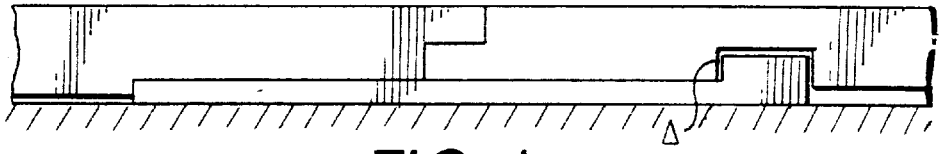
FIG. 1a (PRIOR ART)
FIGS. 1*a*–1*d* are embodiments of the prior art planks.
Figure 1B:
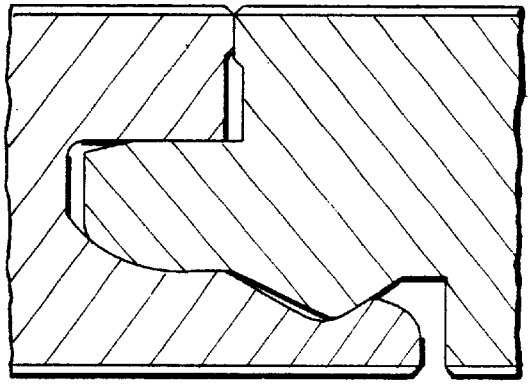
FIG. 1b (PRIOR ART)
Figure 1C:
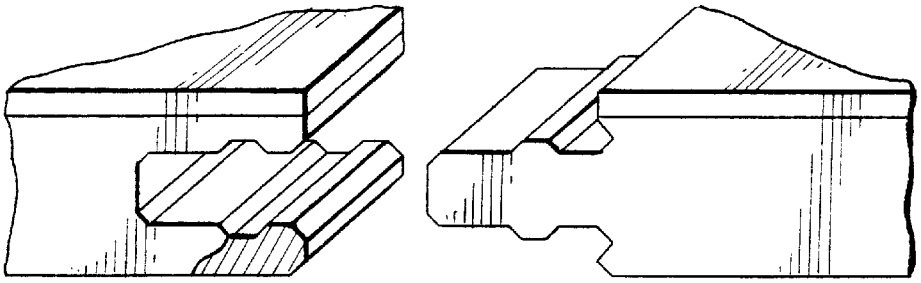
FIG. 1c (PRIOR ART)
Figure 1D:
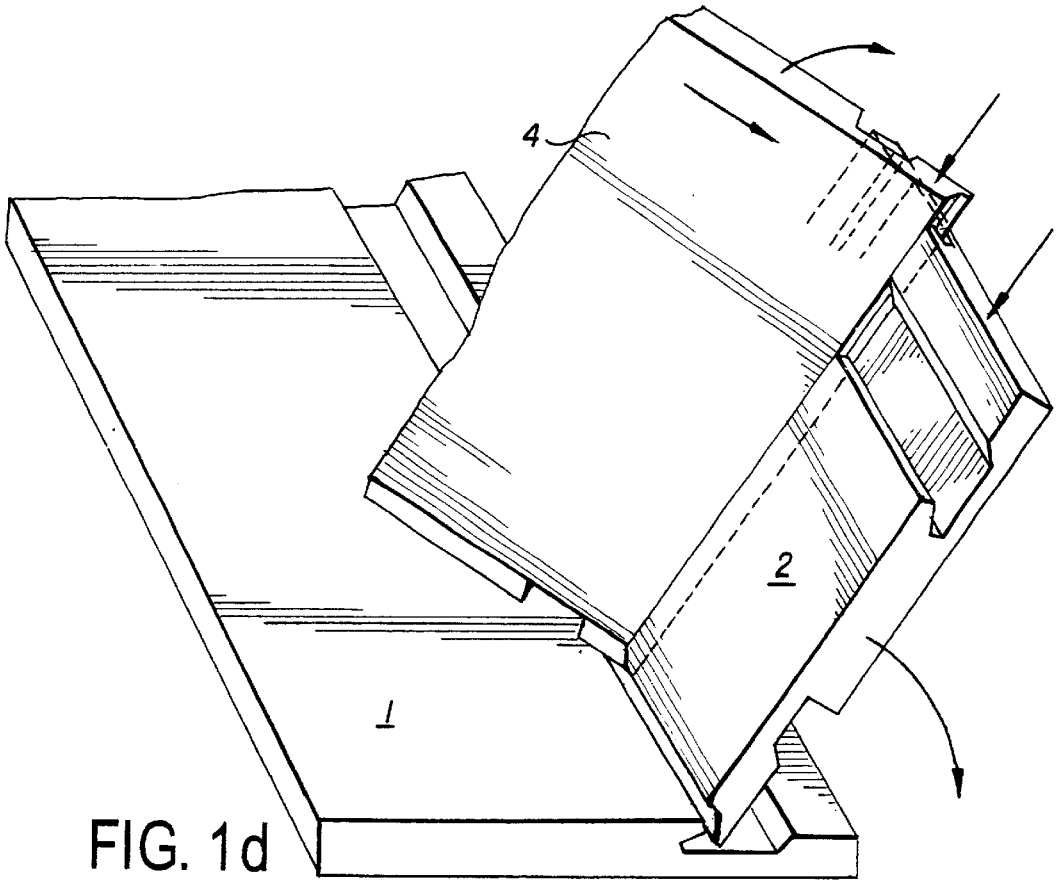
FIG. 1d (PRIOR ART)
Figure 2:
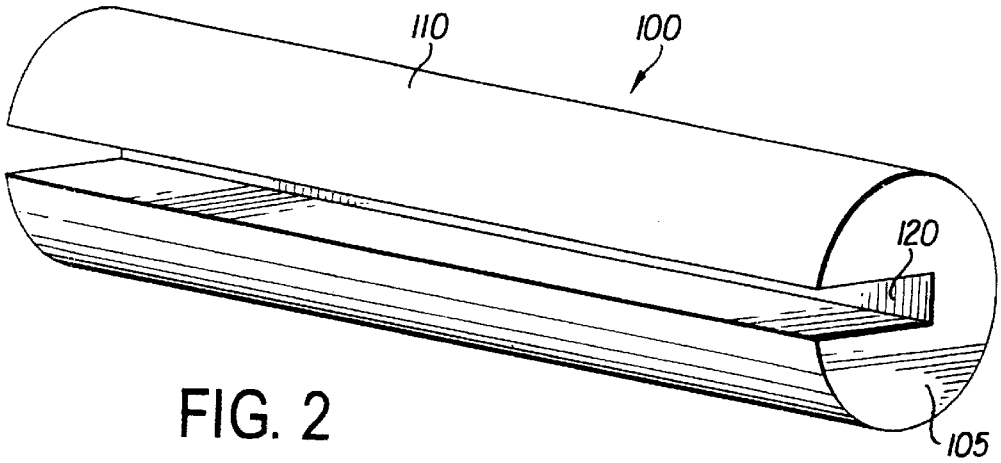
FIG. 2 is a perspective view of one embodiment of the tool of the invention.
Figure 3:
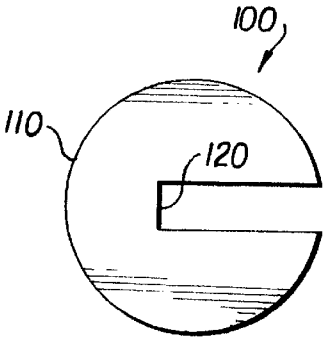
FIG. 3 is an end view of the tool of the invention.

FIG. 2 is a perspective view of one embodiment of tool 100. The tool 100 has a body 105 which can be formed of any suitable material, such as natural or reconstituted wood, rigid or rubbery polymeric materials, metals, such as aluminum and its alloys, and composites, such as a core of wood or metal, and an outer covering of a flexible material, such as rubber or foamed plastic. In any event, surface 110 of tool 100 should be ergonomic, so as to facilitate its use by the installer of a floor, minimizing stress or fatigue. We have found that an arcuate surface, preferably one of circular or elliptic configuration is suitable for more purposes. However, when surface 110 is the outer covering, and is formed of a rubbery of foamed plastics materials, the surface 110 may deform so as to interdigitate with the fingers of the consumer further facilitating its use. It is important that tool 100 be constructed of such material that it will prevent an edge of a floor plank, placed within its groove 120 from contacting a subfloor. Body 105 is constructed so as to define groove 120 which is sized and shaped to receive an edge of a floor plank and to be slidable along said edge. Preferably, groove 120 extends more than halfway through body 105.

Figure 4:
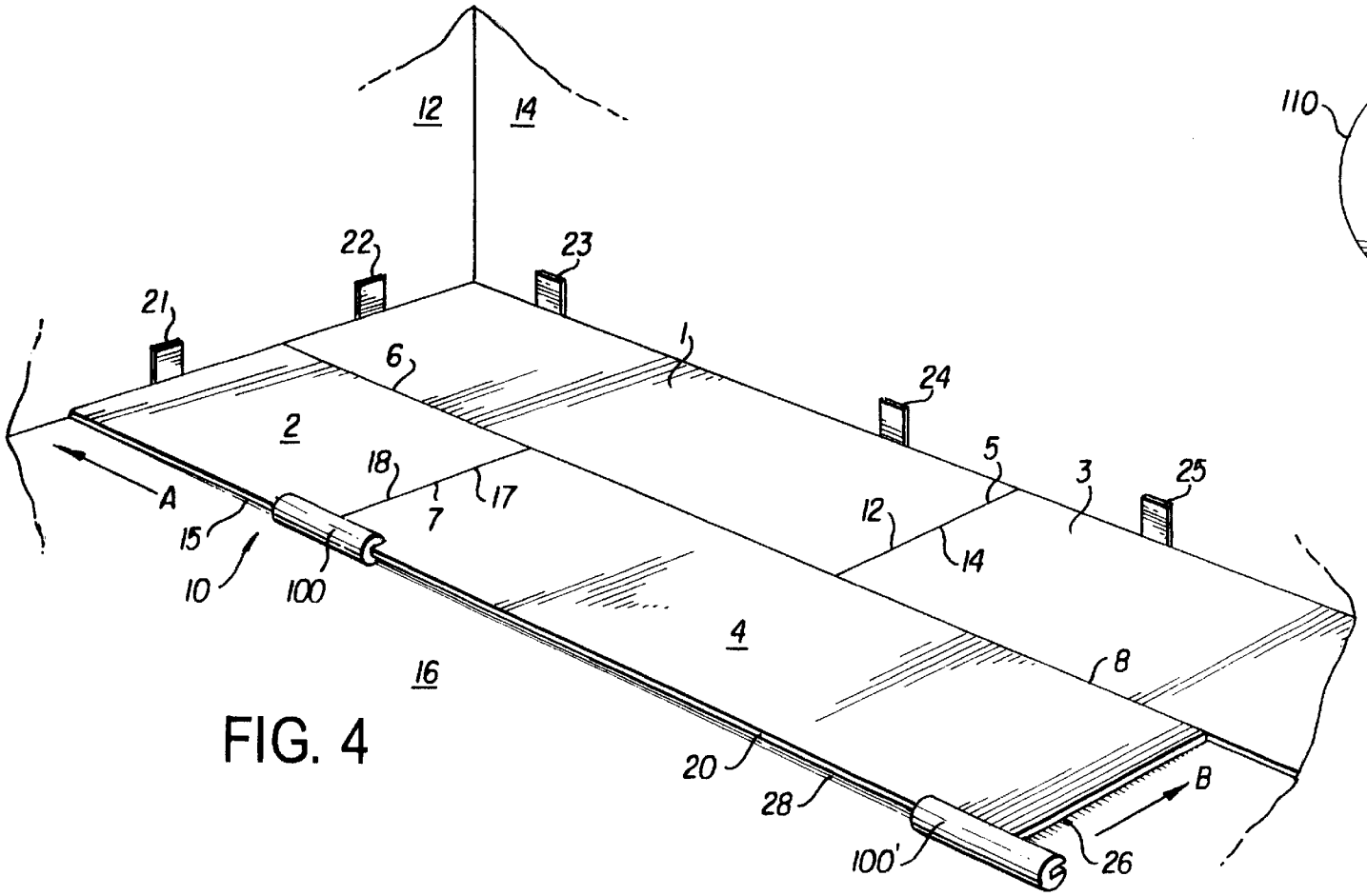
FIG. 4 is a perspective view of the use of the tool of the invention in assembling a floor from a plurality of floor planks.

As shown in FIG. 4, illustrating a typical installation of floor planks into a floor, spacers 21, 22, 23, 24, 25 are placed between the floor 10 and walls 12, 14 of the room into which the floor 10 is to be installed. The subfloor 16 can be of any conventional material, such as plywood or concrete, but it usually is covered by one or more layers selected from a moisture barrier such as plastic or metallized film; a sound deadening layer such as a foamed plastic material, and/or a cushioning layer.

Planks 1, 3 in a first row are joined at their short edges 12, 14 to form joint 5 in any suitable manner.

Joint 6 is formed between plank 1 and plank 2 by joining the long edge of plank 1 to the long edge of plank 2. (We use the term long edge of plank 2 even though plank 2 may be square or cut so as to form a staggered joint array between joint 5 and joint 7.) At any time before plank 2 is placed close to subfloor 16, tool 100 is placed around the edge 15 of panel 2 so as to prevent panel 2 from laying flat on subfloor 16, or laying flush with panels 1, 3.

Second panel 4 in the second row is then joined at its short end 17 to short end 18 of panel 2 by any suitable method, e.g., "angling down," according to the method disclosed in the aforementioned Terbrack et al patent.

During this step, tool 100 may be positioned slightly to the left along line A so as to expose the short side 18 of panel 2 for contact with short edge 17 of panel 4 so as to form joint 7. Tool body 105 is configured in defining groove 120 so as to permit tool 100 to receive an edge of panel 2 and be slidable along said edge. As noted above, the tool 100 is slidable along the edge of the panel may be slid to the position shown in FIG. 4. After forming joint 7, panel 2 will still be spaced from panels 1, 3, along joint 8. Joint 8 can be formed by placing a second tool 100' along edge 20 of panel 4 and preferably pulling on tool 100, 100' to urge panel 4 towards panels 1, 3 in a direction B parallel to panel edge 26. It will be seen that tools 100, 100', etc. maintain a space 28 between plank 4 (and any succeeding plank) and subfloor 16.

The remainder of the first and second (or any succeeding rows) may then be assembled in the same fashion with the entire second (or any succeeding) row is fully laid-out along the entire length of the room.

Thereafter, tool 100, 100', etc. may then be removed, preferably in sequence in a direction from the first plank laid to the last plank laid, permitting the second (or any succeeding) row to lay flat against the subfloor and in the same plane as the panels previously laid. The remainder of the floor can be laid following the laying of the first and second rows. In an alternative embodiment, the entire row can be laid out, resting on a plurality of tools, 100, 100'. 100''' (not shown) and thereafter may be joined in sequence at their long edges to the second (or any succeeding) row by urging the panels, seriatim, in a direction toward the preceding laid row.

Of course, glue may be applied before laying to waterproof, seal, and adhere the planks at their edges. Although the laying procedure has been illustrated for rectangular planks, other shapes may be laid, e.g., square or other quadrilateral shapes.

It is also within the scope of the invention that the first two rows (or any partial section thereof) be assembled away from walls 12, 14 so as to permit sufficient room for the installer to pull upon tools 100, 100', etc. Once assembled, the first and second rows can be positioned against spacers 21–25, such as by sliding the assembled rows together over subfloor 16.

Although we have illustrated planks having joint edges on the long and short sides of the plank, it will be evident to those skilled in the art that the planks may have joint edges only on one edge, opposing edges, all edges, and adjacent (long and short) edges and be within the scope of the invention. Additionally, it is within the scope of the invention that when more than one edge is present, the remaining edges may be either the same or different and still be within the scope of the invention.

Although we have designed our tool and method to facilitate assembly of the panels by the use of human muscle power exerted directly on the tool, it does not depart from the appended claims if one were to tap the tool with a hammer, block, or other means to amplify the force applied to the tool.

It is, thus, apparent that we have described a new method of assembling floor planks into a floor. However, it is readily apparent to those skilled in the art that our invention is applicable to embodiments other than as described and illustrated herein and are within the scope of the invention as defined by our claims appended hereto.

We claim:

1. A method of installing floor planks having tongue and groove edges, said method comprising:

laying at least two planks in a first row on a subfloor;

laying the first plank in the second row by joining one edge of the first plank to at least one of the edges of at least one plank in said first row;

preventing said first plank from laying flat on the subfloor by placing a tool around an edge of the first plank opposite said one edge of said first plank.

2. The method of claim 1, wherein the planks are rectangular and said one edge of said first plank is a long edge of said plank.

3. The method of claim 2, wherein a second plank is laid in a second row by first joining the short edges of said first and said second planks.

4. The method of claim 2, wherein said second plank is prevented from contacting said subfloor by placing a tool around an edge of said second plank.

5. The method of claim 4, wherein said tool placed around the edge of said second plank, is the same tool used to prevent said first plank from laying flat.

6. The method of claim 4, wherein said tool placed around the edge of said second plank is a tool different from the tool used to prevent said first plank from laying flat.

7. The method of claim 5, wherein said tool used to prevent said first plank from laying flat is slidable along an edge of said first and second planks.

8. The method of claim 3, wherein said second plank is joined at its long edge to the edge of at least one plank in the first row by exerting hand force on the tool in a direction towards said first row.

9. The method of claim 4, wherein a force is applied to said tool in a direction of the first row.

10. The method of claim 9, wherein the force is that exerted by a human hand.

11. A tool for installing tongue and groove flooring planks, said tool comprising a body having an outer surface, said body defining a groove dimensioned so as to receive within said groove an edge of said flooring plank, in combination with a flooring plank.

12. The tool of claim 11, wherein said body is formed of wood.

13. The tool of claim 11, wherein said outer surface has an arcuate configuration.

14. The tool of claim 11, wherein said outer surface has a circular profile.

15. Two or more tools for installing tongue and groove flooring planks, said tools each comprising a body having an outer surface, said body defining a groove dimensioned so as to receive within said groove an edge of said flooring plank, in combination with a flooring plank.

16. A method of installing floor planks to form a floor including placing the tool according to claim 10 along an edge of at least one of said floor planks so as to prevent said floor plank from lying flat on a subfloor.

17. The method according to claim 16, wherein additional tools according to claim 10 and placed on each plank so as to prevent said each plank from lying flat on a subfloor.

18. The method according to claim 17, wherein each of said tools are removed after all planks in a row of planks are laid.

19. The method of claim 17, wherein said tools are used to exert a force on the planks towards a previously laid row of planks.

20. A tool for installing tongue and groove flooring planks, said tool comprising:

a body and means for receiving an edge of said flooring plank, wherein said body is shaped as to prevent an edge of said flooring plank from contacting a subfloor below said flooring planks, in combination with a flooring plank.

21. The tool of claim 11, wherein said body has an ergonomic outer surface.

* * * * *